US006254432B1

(12) United States Patent
Yoshigi

(10) Patent No.: US 6,254,432 B1
(45) Date of Patent: Jul. 3, 2001

(54) SEALING STRUCTURE IN A SENSOR HAVING LEAD WIRES

(75) Inventor: Toshimasa Yoshigi, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/553,080

(22) Filed: Apr. 20, 2000

(30) Foreign Application Priority Data

Apr. 22, 1999 (JP) ..... 11-114560

(51) Int. Cl.[7] ..... H01R 13/58
(52) U.S. Cl. ..... 439/604; 439/936
(58) Field of Search ..... 439/587, 936, 439/934, 736, 604, 271

(56) References Cited

U.S. PATENT DOCUMENTS 3,457,441 * 7/1969 Phillips et al. ..... 310/71
4,083,902 * 4/1978 Clyde ..... 264/26
4,454,381 * 6/1984 Ito et al. ..... 174/151
5,561,273 * 10/1996 Yamanashi ..... 174/152 R
5,603,627 * 2/1997 Evanisko ..... 439/235
5,637,007 * 6/1997 Suzuki et al. ..... 439/276

* cited by examiner

*Primary Examiner*—Brian Sircus
*Assistant Examiner*—Son V. Nguyen
(74) *Attorney, Agent, or Firm*—Armstrong, Westerman, Hattori, McLeland & Naughton, LLP

(57) ABSTRACT

A sealing structure for a sensor having lead wires, which comprises an electric element (2) provided with a plurality of lead wires (3, 4) and contained in a case (1), a rubber plug (5) inserted into an opening (8) in the case, the lead wires being guided out of the rubber plug through respective bores (13) formed therein, and a filling material (9) filled in the opening (8) above the rubber plug, the rubber plug (5) being provided with a partition wall (7) for providing a space between the lead wires (3, 4), the partition wall (7) being disposed in the filling material (9), whereby the lead wires (3, 4) are spaced from each other by the partition wall. A top end of the partition wall (7) may reach a level of a surface (9*a*) of the filling material (9). Lateral faces (7*a*) of the partition wall (7) may be in alignment with extension lines of inner faces of the bore (13). The partition wall (7) is integrally formed with the rubber plug (5), and formed of the same material as the rubber plug or a different resin material.

7 Claims, 3 Drawing Sheets

SEALING STRUCTURE IN A SENSOR HAVING LEAD WIRES

BACKGROUND OF THE INVENTION

1. Field of the Invention

The present invention relates to a sealing structure in a sensor having lead wires such as a brake fluid (oil) level sensor in a vehicle, and more particularly to the sealing structure in which a filling material for the seal is prevented from intruding into a spacing between the lead wires.

2. Description of the Related Art

FIG. 3 shows a sealing structure in a conventional sensor having lead wires. This structure consists of a case 1 formed of a synthetic resin, a reed switch 2 contained in the case 1 and provided with lead wires 3, 4, a rubber plug 19 provided outside the lead wires 3, 4 and fitted to an inner peripheral wall 6*a* of the case 1, and a resin material 9 filled in an opening 8 of the case 1 above the rubber plug 19 in order to hold the lead wires 3, 4 and seal the reed switch 2.

The reed switch 2 contains therein a pair of magnetic reeds (not shown) whose contact portions are brought into contact by magnetization, and generally employed as a fluid level sensor for a brake or clutch in a vehicle. The sensor 18 having the lead wires is disposed in such a manner that the reed switch 2 faces with a magnetic area in a float (not shown) in an operating fluid such as the brake fluid.

A pair of lead terminals 16, 17 of the reed switch 2 are connected by soldering to conductive terminals 3*a*, 4*a* of the lead wires 3, 4 respectively. A pair of the lead wires 3, 4 are passed through bores 13 (FIG. 4) in the rubber plug 19 and guided out of the opening 8 of the case 1 to the connector 11. The connector 11 is composed of a housing 20 formed of a synthetic resin and terminals (not shown) contained in the housing 20. To the terminals are pressure welded distal ends of the lead wires 3, 4.

The case 1 is formed in an oblong shape in cross section, including a bottom portion 14 at one end and the opening 8 at the other end in a longitudinal direction. The opening 8 is enlarged in diameter in a tapered shape. The rubber plug 19 is inserted into the case 1 to be fitted to the inner peripheral face 6*a* of a cylindrical wall 6 which is straight and continues from the tapered part 8*a*.

As shown in FIG. 4, at an outer periphery of the rubber plug 19 are formed a plurality of lip portions 12 for tight fitting to the inner peripheral face 6*a* of the case 1. The bores 13 in the rubber plug 19 are provided slightly apart from each other in a lateral direction so as to correspond to a space between a pair of the lead wires 3, 4. The inner peripheries of the bores 13 are also provided with lip portions (not shown), which are adapted to be tightly fitted to the outer peripheral faces of the lead wires 3, 4.

In FIG. 3, the resin material 9 is filled between an upper end face 19*a* of the rubber plug 19 and an inlet 8*b* of the opening 8 of the case 1. The opening 8 covers herein a rather wide area including the inlet 8*b* and the tapered part 8*a* which is enlarged in diameter. The resin material 9 which is an epoxy resin or the like will be hardened after poured thereby to hold the lead wires 3, 4 in the case 1, and at the same time, to seal the reed switch 2 and the lead wires 3, 4 inside the case 1. The case 1, the reed switch 2, the lead wires 3, 4, the rubber plug 19 and the resin material 9 constitute the sensor 18 having the lead wires which is the brake fluid level sensor.

The brake fluid level sensor 18 is fixed to a bottom wall of a brake master cylinder (not shown) in the vehicle and may be disposed in the brake fluid, for example. In this case, the rubber plug 19 and the resin material 9 will prevent the brake fluid from intruding into the case 1. In case that the brake fluid level sensor is disposed outside the brake master cylinder, the rubber plug 19 and the resin material 9 will serve for waterproofing or dustproofing purposes.

However, in the above described conventional structure, there has been a problem that when the resin material 9 is poured into the opening 8 of the case 1, the resin material 9 will enter into and rise along a narrow spacing 21 between the lead wires 3, 4 by a capillary phenomenon, as shown in FIG. 3 in an enlarged scale. The resin material 9 thus hardened in this state will create a sharp projection 22 between the lead wires 3, 4, which may damage the coverings on the lead wires 3, 4 when the lead wires 3, 4 are bent at an end face 9*a* of the resin material 9. This problem may be the same in such a case that a hard rubber material is employed instead of the resin material 9. Particularly, in case where a bending force is applied to the lead wires 3, 4 in filling the resin material 9, the lead wires 3, 4 will be hardened as they are bent and create gaps in the resin material 9, resulting in poor sealing property and deterioration in quality of the products.

BRIEF SUMMARY OF THE INVENTION

In view of the above described problems, the object of the present invention is to provide a sealing structure for a sensor having lead wires in which a filling material will not rise along a spacing between lead wires when the filling material such as resin is poured into an opening of a case from which a plurality of the lead wires are guided out, and accordingly, damages of the lead wires will be avoided and the lead wires can be held at normal positions even in case where a bending force is applied to the lead wires when filling the resin material.

In order to attain the above described object, there is provided according to the present invention, a sealing structure for a sensor having lead wires which comprises an electric element provided with a plurality of the lead wires and contained in a case, a rubber plug inserted into an opening of the case, the lead wires being guided out of the rubber plug through respective bores formed therein, and a filling material filled in the opening above the rubber plug, the rubber plug being provided with a partition wall for providing a space between the lead wires, and the partition wall being disposed in the filling material, whereby the lead wires are spaced from each other by the partition wall.

According to another aspect of the invention, a top end of the partition wall reaches a level of a surface of the filling material.

According to a further aspect of the invention, lateral faces of the partition wall are in alignment with extension lines of inner faces of the bores.

According to a still further aspect of the invention, the partition wall is formed of the same material as the rubber plug integrally therewith.

According to a still further aspect of the invention the partition wall is formed of a resin material different from the rubber plug.

Now, a preferred embodiment according to the invention will be described by way of examples referring to the drawings.

DESCRIPTION OF THE PREFERRED EMBODIMENTS

Figure 1:
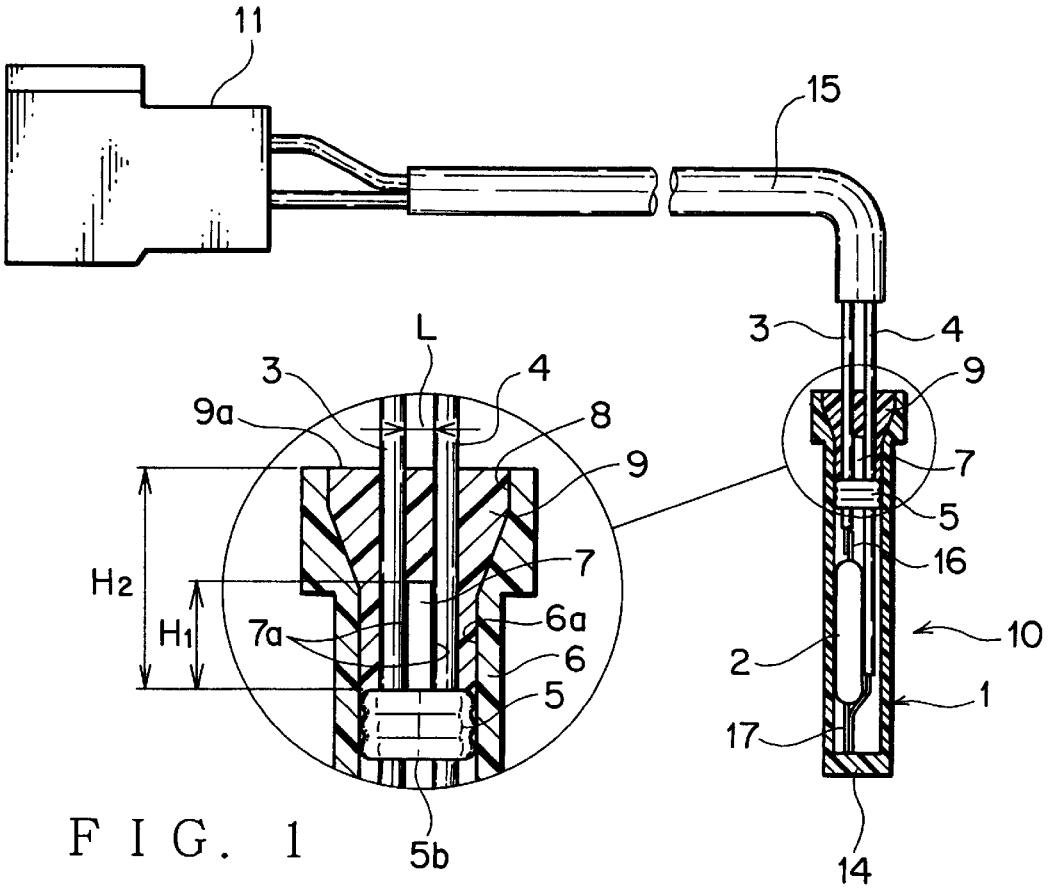
FIG. 1 is a side view of a sealing structure for a sensor having lead wires in one embodiment according to the present invention shown in a longitudinal section (encircled is an enlarged view)

FIG. 1 shows an embodiment of a sealing structure for a sensor having lead wires according to the present invention.

In this structure, a reed switch 2 having a pair of lead wires (covered electric wires) 3, 4 is contained in a case 1 formed of a synthetic resin. A rubber plug 5 provided around the lead wires 3, 4 is tightly fitted to an inner face 6*a* of the case 1, and a rib 7 mounted on the rubber plug 5 acts to position the lead wires 3, 4 apart from each other on both sides of the rib 7 to keep a spacing L therebetween, thereby preventing a rise of a resin material 9 between the lead wires 3, 4 when the resin material 9 is filled above the rubber plug 5 in an opening 8 of the case 1.

Because other components than the rubber plug 5, namely, the case 1, the reed switch 2, the lead wires 3, 4, and the resin material 9 constituting the sensor 10 as well as the structure of the connector 11 connected to the lead wires 3, 4 are the same as in the conventional case, the components will be denoted with the same reference numerals to omit a detailed explanation. Uses of the sensor 10 having the lead wires are also the same as in the conventional case. For example, when a level of an operating fluid in a brake master cylinder in a vehicle is lowered below a prescribed level, the reed switch 2 will be actuated to give a warning to a driver's seat by way of the connector 11.

Figure 2:
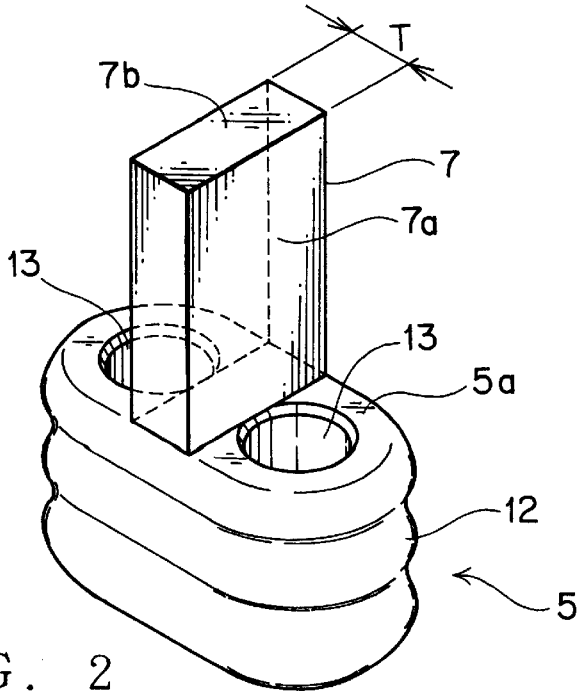
FIG. 2 is a perspective view of a rubber plug provided with a rib.
Figure 3:
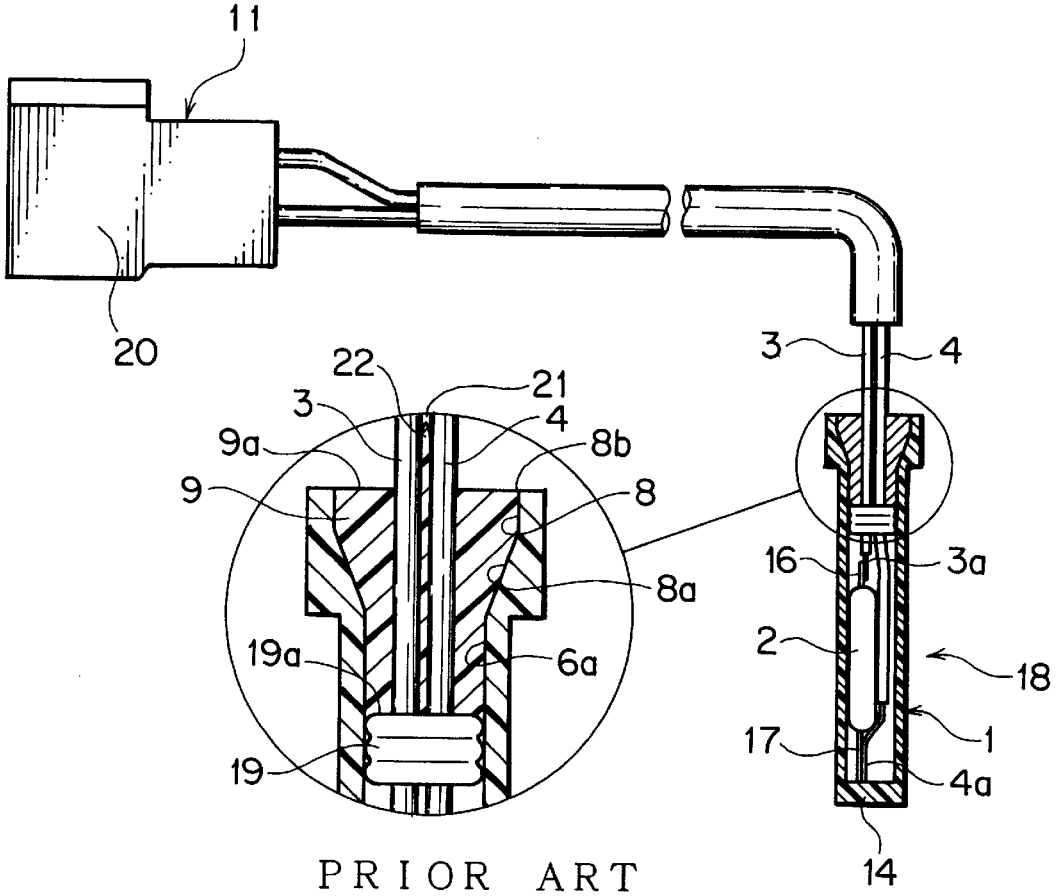
PRIOR ART FIG. 3
FIG. 3 is a cross sectional view of a conventional structure (encircled is an enlarged view)
Figure 4:
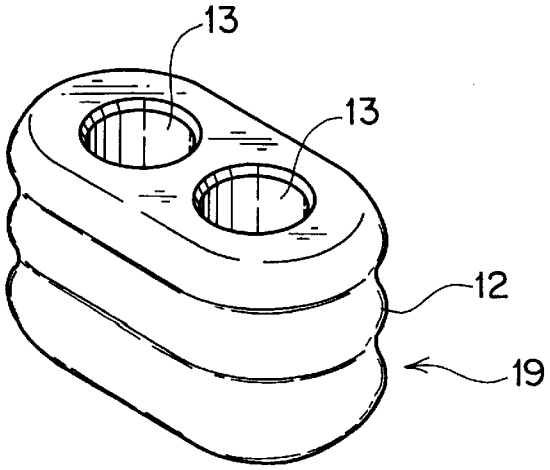
PRIOR ART FIG. 4
FIG. 4 is a perspective view of a conventional rubber plug.

The rubber plug 5 is formed in an oblong shape in the same manner as in the conventional case, and provided with a plurality of lip portions 12 at its peripheral face and a pair of through bores 13, 13 between its end faces 5*a*, as shown in FIG. 2. This rubber plug 5 is further provided with a rib 7 in a form of a rectangular flat plate and projecting vertically from one of the end faces 5*a*. The rib 7 has a width substantially equal to a shorter diameter of the rubber plug 5, and is uprightly provided at a center of the rubber plug 5 in a direction of a longer diameter thereof.

The rib 7 may be integrally formed of the same rubber material as the rubber plug 5 integrally therewith or may be formed of a synthetic resin which is different from the material of the rubber plug 5 by complex molding. The complex molding means a method wherein the rubber plug 5 is first molded of rubber material and then a synthetic resin is supplied above the rubber plug 5 by injection or the like to form the rib 7. The rib 7 of the synthetic resin may be embedded deep into a middle portion of thickness of the rubber plug 5 or from one end face 5*a* to the other end face.

As shown in FIG. 1, the rib 7 is positioned between a pair of the lead wires 3, 4 in the opening 8 of the case 1. The lead wires 3, 4 extend rectilinearly along wide lateral faces 7*a* at both sides of the rib 7. As shown in FIG. 2, the lateral faces 7*a* are preferably positioned adjacent to the bores 13 in the rubber plug 5 or in flush with the inner faces of the bores 13 in a state where the rubber plug 5 is not inserted in the case 1 and free from the lead wires 3, 4.

With this arrangement, the lead wires 3, 4 guided out of the bores 13 are surely kept in contact with the lateral faces 7*a* of the rib 7, and laterally separated from each other leaving the same as or a larger spacing than a thickness T of the rib 7 (FIG. 2). In case where the lateral faces 7*a* of the rib 7 are in flush with the inner faces of the bores 13, the lead wires 3, 4 respectively inserted (press-fitted) into the bores 13 come in tight contact with the lateral faces 7*a* or a root of the rib 7 and receive a force in an outward direction in which they are adapted to be separated. Accordingly, the spacing L between the lead wires can be secured or rather enlarged in a diverging manner.

Figure 5:
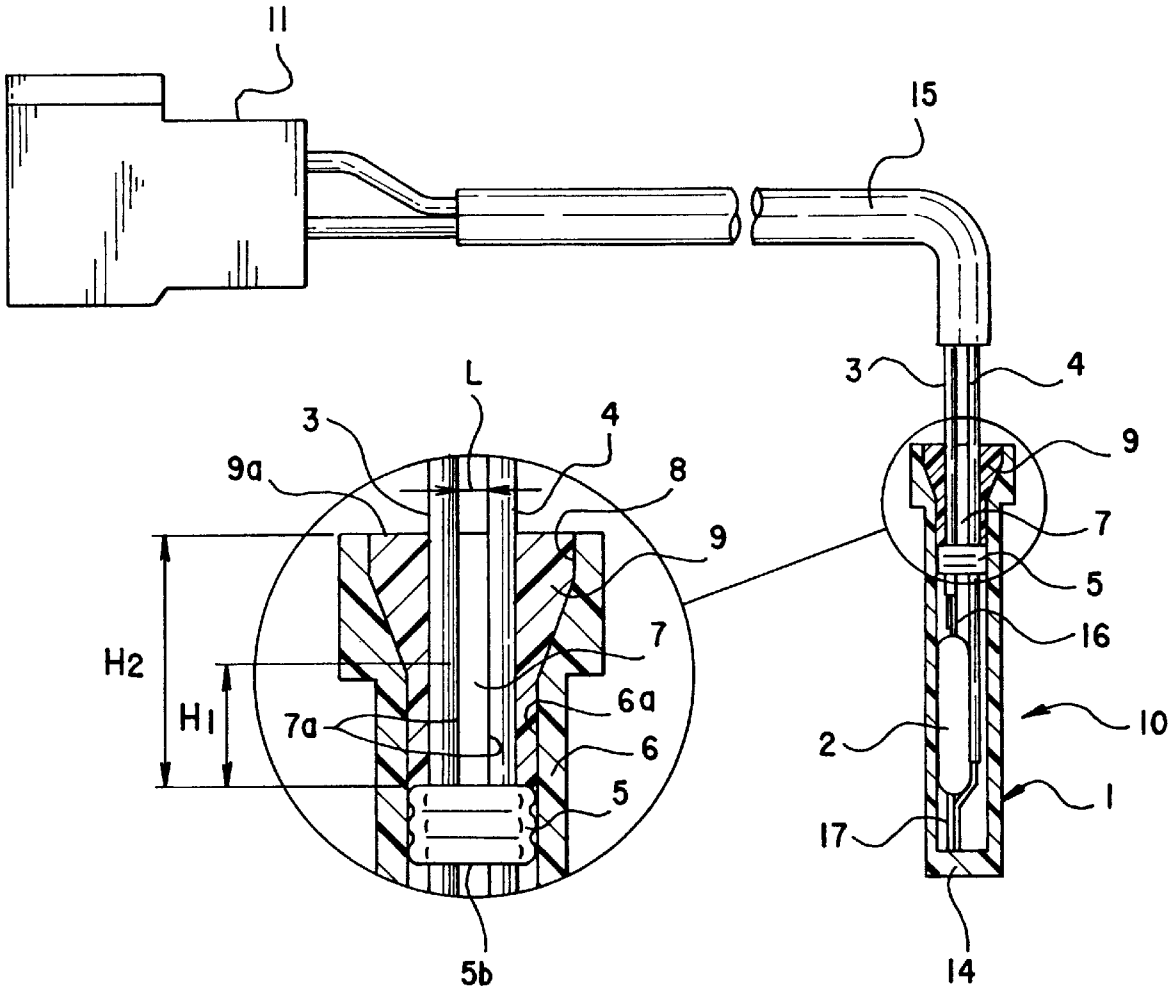
FIG. 5 is a side view of a sealing structure for a sensor having lead wires, in another embodiment according to the present invention, shown in a longitudinal section (encircled is an enlarged view).

In the embodiment in FIG. 1, a length (projecting height) H1 of the rib 7 is shorter than a filling depth H2 of the resin material 9. However, as shown in FIG. 5, the length H1 of the rib 7 can be set equal to the filling depth H2, whereby the wider spacing can be accurately defined between the lead wires 3, 4, and the rise of the free-flowing resin material 9 by a capillary phenomenon will be more reliably prevented. Preferably, the top end 7*b* of the rib 7 is not exposed from the surface 9*a* of the resin material 9 from the viewpoint of sealing property. If the rib 7 is made longer than the filling depth H2, there will be a fear that the lead wires 3, 4 may interfere with the top end 7*b* of the rib 7 when they are bent, although the larger spacing L can be secured.

The length of the rib 7 is about 8.5 mm, and the spacing L between the lead wires 3, 4 is about 1 mm in one example. It is possible to provide holding grooves (not shown) for the lead wires 3, 4 by curving the lateral faces 7*a* of the rib 7. It is also possible to provide the rib 7 so as to project from the inner face 6*a* of the case 1 instead of the rubber plug 5, in case where the rubber plug 5 can be inserted from a bottom portion 14 of the case 1, that is, when the bottom portion 14 is free to open.

In FIG. 1, a pair of the lead wires 3, 4 guided out in parallel leaving the wide spacing L to such an extent that the capillary phenomenon will not occur are bundled and wrapped with a vinyl tape 15 or the like to be connected to the connector 11. By thus wrapping them with the vinyl tape 15, a distance between the lead wires 3, 4 can be kept as large as the thickness of the rib 7. Injection of the free flowing resin material 9 into the case 1 is conducted in a state where the lead wires 3, 4 are guided out in a vertical direction.

When the resin material 9 is injected into the opening 8, it will not rise along the lead wires 3, 4, because the large spacing L is defined between the lead wires by means of the rib 7. Further, because the lead wires 3, 4 are guided in a vertical direction along the rib 7, the lead wires 3, 4 can be accurately positioned when molding the resin material and fixed at determined positions by the resin material 9 in a vertically supported state by means of the rib 7 without leaning.

The lead wires 3, 4 run in parallel in the case 1. The one lead wire 3 is soldered to one terminal 16 of the reed switch 2 at a position slightly below an end face 5*b* of the rubber plug 5, and the other lead wire 4 is extended in parallel along the reed switch 2 in a longitudinal direction and soldered to the other terminal 17.

The lead wires 3, 4 are inserted into the bores 13 of the rubber plug 5, before the lead wires 3, 4 are connected to the reed switch 2. After the lead wires 3, 4 has been connected to the reed switch 2, the reed switch 2 is inserted into the case 1 together with the rubber plug 5. Then, the resin material 9 is filled into the opening 8 of the case 1 above the rubber plug 5. The case 1 is in an oblong shape in cross section corresponding to the shape of the rubber plug 5.

As described above, the structure in which the rib 7 is interposed between the lead wires 3, 4 as a partition between them and the spacing L between the lead wires is forcibly expanded is also effective as a sealing method for the sensor having the lead wires.

There is also provided a method of manufacturing the sensor having the lead wires comprising steps of containing the reed switch 2 having a plurality of the lead wires 3, 4 in the case 1, guiding the lead wires 3, 4 out of the rubber plug 5 through the bores 13, inserting the rubber plug 5 into the opening 8 in the case 1, and filling the resin material (filling material) 9 in the opening 8 above the rubber plug 5, characterized in that the rubber plug 5 is provided with the rib 7 (partition wall) which is positioned in the resin material 9 to separate the lead wires 3, 4 from each other.

Although the invention has been described referring to the structure employing the two lead wires 3, 4 in the above described embodiment, in case where three or more lead wires are employed, the rib 7 may be in such a form as corresponding to the arrangement of the lead wires. For example, for the three lead wires, the rib 7 may be in a Y-shape equidistant at 120 degree, and for the four lead wires, the rib 7 may be in a shape of a cross. Further, the sensor 1 having the lead wires is not limited to the brake fluid level sensor, but may include all other electric elements instead of the reed switch 2.

As described, the lead wires are separated by means of the partition wall to provide the wide spacing between the lead wires having substantially the same size as the thickness of the partition wall, the filling material will not rise by the capillary phenomenon as in the conventional structure when it is filled in the opening in the case. Accordingly, a thin and sharp projection of the filling material which will damage the lead wires when they are bent will not be produced between the lead wires. Further, the lead wires can be accurately positioned by the partition wall to linearly extend in the opening, and such a defect that the lead wires are fixed in a bent state will not be arisen. Moreover, the spacing between the lead wires can be securely maintained both in the filling material and in the extension lines of the lateral faces of the partition wall, and the lead wires will not interfere with each other.

What is claimed is:

1. A sealing structure for a sensor having lead wires which comprises;

an electric element provided with a plurality of said lead wires and contained in a case having an opening at one end, a rubber plug inserted into said opening in said case, said lead wires being guided out of said rubber plug through respective bores formed therein, and a filling material filled in said opening above a top end face of said rubber plug, wherein said top end face of said rubber plug faces to said one end of the case, a partition wall, extending above the top end face of said rubber plug, for providing a space between said lead wires, whereby said lead wires are spaced from each other by said partition wall, said partition wall having lateral faces entirely disposed in said filling material.

2. The sealing structure for the sensor having the lead wires as claimed in claim 1, wherein a top end of said partition wall and a top surface of said filling material are at the same level.

3. The sealing structure for the sensor having the lead wires as claimed in claim 1 or 2, wherein two opposing lateral faces of said partition wall are flush with inner faces of said bores.

4. The sealing structure for the sensor having the lead wires as claimed in claim 1 or 2, wherein said partition wall is formed of the same material as said rubber plug integrally therewith.

5. The sealing structure for the sensor having the lead wires as claimed in claim 1 or 2, wherein said partition wall is formed of a resin material different from said rubber plug.

6. The sealing structure for the sensor having the lead wires as claimed in claim 3, wherein said partition wall is formed of the same material as said rubber plug integrally therewith.

7. The sealing structure for the sensor having the lead wires as claimed in claim 3, wherein said partition wall is formed of a resin material different from said rubber plug.

* * * * *